United States Patent [19]

Carbonetti

[11] Patent Number: 4,943,058

[45] Date of Patent: Jul. 24, 1990

[54] TENNIS RACKET WITH FIXED GRIP AND MOVABLE FRAME

[76] Inventor: Italo Carbonetti, 11 Via Prassitele, I-00125 Axa Acilia Sud RM, Italy

[21] Appl. No.: 313,525

[22] Filed: Feb. 22, 1989

[30] Foreign Application Priority Data

Sep. 21, 1988 [IT] Italy ..... 48367 A/88

[51] Int. Cl.[5] ..... A63B 49/08

[52] U.S. Cl. ..... 273/73 J; 273/75; 273/81 C

[58] Field of Search ..... 273/75, 73 J, 67 DA, 273/81 R, 81 B, 81 C, 81 D, 165

[56] References Cited

U.S. PATENT DOCUMENTS

| | | | |
|---|---|---|---|
| 1,305,952 | 6/1919 | Suesman | 273/81 C |
| 3,203,697 | 8/1965 | Berzatzy | 273/75 |
| 3,534,960 | 10/1970 | Hanks | 273/75 |
| 3,834,714 | 9/1974 | Smolinski | 273/81 C X |
| 4,072,311 | 2/1978 | Bertucci | 273/75 |
| 4,101,125 | 7/1978 | Heath | 273/75 |
| 4,365,807 | 12/1982 | Melby | 273/81 B X |
| 4,693,475 | 9/1987 | Keilhau | 273/81 C X |
| 4,826,168 | 5/1989 | McGuire et al. | 273/81 C X |

FOREIGN PATENT DOCUMENTS

| | | | |
|---|---|---|---|
| 2444304 | 3/1976 | Fed. Rep. of Germany | 273/75 |
| 2458572 | 6/1976 | Fed. Rep. of Germany | 273/75 |
| 2458581 | 6/1976 | Fed. Rep. of Germany | 273/75 |

*Primary Examiner*—Edward M. Coven
*Assistant Examiner*—William E. Stoll
*Attorney, Agent, or Firm*—Browdy & Neimark

[57] ABSTRACT

In order to obtain a correct dynamic position in power shots and to avoid traumas to the joints the handle of the racket can assume various angular positions around its axis in order to vary the angular attitude of the string-bearing frame, while an anatomical grip remains stable on the handle (FIG. 1).

4 Claims, 1 Drawing Sheet

TENNIS RACKET WITH FIXED GRIP AND MOVABLE FRAME

BACKGROUND OF THE INVENTION

1. Field of the Invention

The present invention refers to a tennis racket which allows a correct grip to be maintained, while the frame bearing the strings is able to assume a graduated series of angled positions around the axis of the handle.

The problem to be solved by the present invention consists in the fact that the conventional racket is not constructed in such a way as to adapt itself to the anatomical necessities of these dynamics, and for this reason it is well known that those practising this sport can suffer from traumas to the elbow and shoulder joints due to an incorrect position for the reception of the shock wave from power shots.

In the traditional tennis racket, in fact, the string-bearing frame is a single piece with the handle, and the tennis player has to grip the handle with the double object of hitting the ball and of giving the frame the desired inclination according to the direction which is to be conferred on the ball itself.

2. Description of the Prior Art

A tennis racket which responds to the necessities indicated above is described in the U.S. patent application Ser. No. 130,316, to which reference is made for a more detailed description of the ballistic advantages, along with the advantages of adaptation to the necessities of anatomic dynamics of a racket of this type.

U.S. Pat. No. 4,101,125 also describes a tennis racket construed with the aim of solving the problem of rendering the handle of the racket turnable with respect to the frame. The structure of this patent again provides hollow spaces in the interior of the handle, which give rise to undesirable noise and resonance at every stroke. Moreover this structure requires that the manufacture by particularly fitted and organised for the construction of the handle and its attachment to the frame, with no possibility of a single adaptation of the existing systems of manufacture.

U.S. Pat. No. 4,365,807 describes a golf club with a grip portion containing alignment indicators to align a rotatable club head to the golfer's stroke. Apart from a generical similarity of the mechanical arrangement between this golf club and the racket of the present invention, the technical dissimilarities in the two different sports of tennis and golf are self-evident. The adjustment of the head by the golfer follows an accurate and lengthy consideration of the stroke and its direction. In tennis there is no time to think too much and the adjustment has to be made in a fraction of second. Also the anatomical and athletical approach to the stroke is considerably different in the two sports. In this connection, reference can be made to the above mentioned U.S. application Ser. No. 130,316. Consequently a tennis racket and a golf club are not comparable under the anatomical and technical points of view.

SUMMARY OF THE INVENTION

In the racket according to the present invention the grip remains stable in order to adapt itself to the requirements of anatomical dynamics, whereas the string-bearing frame is turned by a certain angle with respect to the axis of the handle, according to the type of shot which the tennis player has to face, that is to say forehand, backhand, volley and so on.

The racket according to the present invention therefore has a handle part formed by a hub joined to the junction between the handle and the frame (denominated "heart") and which shows a movable tubular sleeve which slides axially and rotationally on said hub, having an anatomical grip to be held by the hand of the tennis player in order to vary the angular attitude of the frame with respect to the handle, and it is improved by the fact that said hub is of circular section and said movable sleeve has at its lower extremity a toothed crown profile, a knob element integral with the free extremity of the hub has a toothed crown profile which can be meshed in an axial direction with said toothed crown profile of the movable sleeve, an external perifeeral abutment is integral with said hub and placed immediately below the heart of the racket, an external periferal abutment is integral with said sleeve and placed in proximity of its upper extremity, and a compression coil spring abuts between said two periferal abutments externally to the hub and the sleeve, so that said sleeve can be rendered movable with respect to the hub by unmeshing said crown profiles and translating and turning the sleeve against the action of the spring, whereas the meshing of the crown profiles renders the sleeve, and consequently the handle and the hub and with these the racket, integral one with the other.

The racket of the present invention is an improvement to the racket described in the U.S. application Ser. No. 130,316, inasmuch as it provides the advantages listed below.

The resistance of the hub, and therefore of the handle, remains in all ways comparable to that of a traditional racket, without hollowness or cavities.

For this reason the racket according to the invention can be manufactured without substantial modifications to the usual operations for manufacture of rackets, rendering necessary only some supplementary operations in order to produce the racket according to the present invention.

The absence of hollows in the hub avoids the production of unusual noises due to the phenomena of acoustic resonance when hitting the ball.

BRIEF DESCRIPTION OF THE DRAWINGS

The present invention will be better described with reference to a preferred embodiment illustrated in the accompanying drawings, in which.

DESCRIPTION OF THE PREFERRED EMBODIMENT

Figure 2:
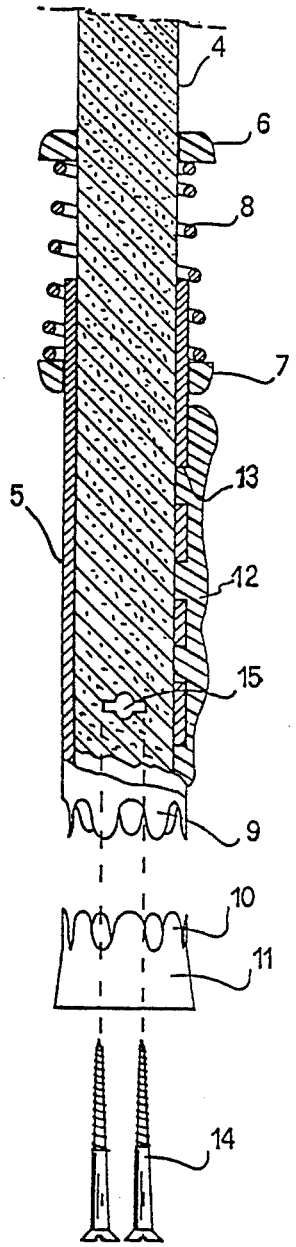
FIG. 2 is an enlarged longitudinal section of the handle along the line II—II of FIG. 1.

The racket according to the invention shows a string-bearing frame 1, which is connected to a handle 2 by means of a connecting area or "heart" 3. The handle 2 is formed by a hub 4. The hub 4 and the frame 1 can be manufactured in various materials, as is known from the state of the art. At present the most advantageous material used is graphitic resin.

The hub 4 must be of circular section, at least in the part nearest to its free extremity, and a movable sleeve 5 is inserted into it, said sleeve being able to rotate around the axis of the hub and translate along it. Said sleeve is advantageously made of extra hard aluminum passed in an anode bath, but other materials can obviously be used. Beneath the connecting area 3, that is to say below the area in which a right-handed tennis player places his left hand, an abutment 6 is applied, integral with the hub 4. On the upper extremity of the movable sleeve 5 an abutment 7 is applied, integral with said sleeve. Between the two abutments a compression coil spring 8 is applied, which encircles both the hub 4 and the sleeve 5 externally.

It can be understood that the movable sleeve 5 can rotate and translate with respect to the hub 4 against the action of the spring 8, which pushes the sleeve 5 towards the free extremity of the hub.

Figure 1:
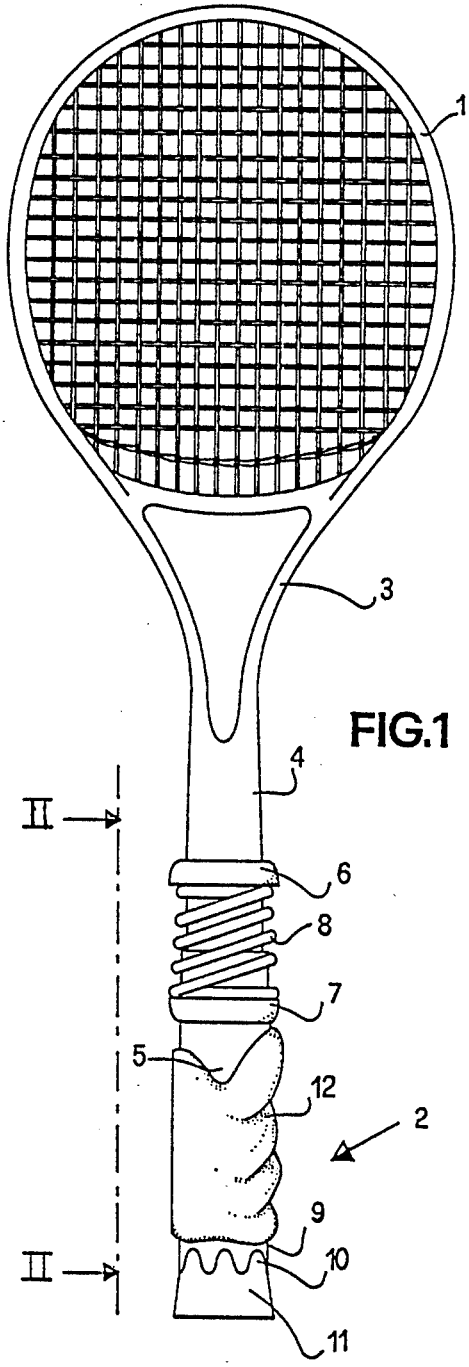
FIG. 1 shows the racket in its general aspect.

The sleeve 5 is shaped at its lower part with a toothed crown profile 9 to be coupled to a complementary toothed crown profile 10 of a knob element or base 11 integral with the free extremity of the hub 4. It can be understood that, as the base 11 is integral with the hub, when the two crown profiles 9 and 10 are meshed (as shown in FIG. 1) the mobile sleeve 5 will be integral with the hub and therefore also with the frame 1, like a conventional racket. On the contrary, by moving the movable sleeve 5 in the direction towards the frame against the action of the spring 8, the crown profiles 9 and 10 become unmeshed and the sleeve 5 will be free to rotate around the axis of the hub 4, thus varying the attitude of the hand gripping the sleeve 5 with respect to the angle of the frame part 1.

On the movable sleeve 5 is applied an anatomical grip 12 which the player grips in a stable manner, whatever the angular attitude of the frame 1 with respect to it may be. Therefore, while the grip on the racket of the player will always remain optimal, the frame can be orientated in steps corresponding to the teeth of the crown profiles 9 and 10 in order to obtain the best angle of the frame 1 with respect to the shot to be made or to the ball to be hit.

The operation is carried out simply by substantially following the technique already used with conventional rackets, holding the racket with the left hand in correspondence with the connecting portion 3 and with the right hand gripping the grip 12 solid with the movable sleeve 5.

It is to be noted that the grip 12, which can easily be made of cold-set acrylic resin, can be manufactured in a personalized manner for each single tennis player, and in particular can be manufactured in a simple manner for a left handed or right handed player.

In FIG. 2 several construction details are shown.

In order to facilitate the fixing of grip 12 to sleeve 5, the sleeve is preferably furnished with holes 13 in which a soft plastic applied on the lower side of the already formed grip can set.

The knob 11 can be applied to the free extremity of the hub 4 by means of screws 14. In order to facilitate the setting of the screws in the hub, a hole 15 with lateral extensions is preferably made in the hub, in correspondence with the area in which the threads of the screws 14 are found. The hole can then be filled with a cement resin in order to increase the setting for the connection of the knob 11 to the hub 4.

The crown profile 10 can be made like a collar, for example in aluminium, fixed externally to the base 11.

It is preferred that the pitch of the teeth of the crown profiles 9 and 10 be such as to allow a rotation of 45° of the frame 1 for each minimum unit of movement.

According to the above description it can be understood that a racket has been provided which, with great constructional simplicity, offers considerable advantages for the efficiency and agility of use.

Although the invention has been described in considerable detail, it is understood that certain changes and modifications can be made in the above construction without departing from the spirit and the scope of the invention.

I claim:

1. In a tennis racket having a frame part and a handle part formed by a hub solid with the frame part, a movable tubular sleeve rotationally and axially sliding on said hub, having an anatomic grip for the gripping of the hand of the tennis player in order to vary the angular attitude of the frame with respect to the grip, to cause the frame to assume a plurality of angular attitudes with respect to it and around its axis, said sleeve having an upper extremity proximal to the frame and a lower opposite extremity, the improvement comprising: said hub is of circular section and said movable sleeve is provided at its lower extremity with a toothed crown profile; a knob element integral with the free extremity of the hub has a toothed crown profile which can be meshed in an axial direction with said crown profile of the movable sleeve; an external periferal abutment is integral with said hub and disposed immediately below the connection of the hub with the frame; an external periferal abutment is integral with said sleeve and placed in proximity to the upper extremity of the same; and a compression coil screw abuts between said two periferal abutments externally to said hub and said sleeve, so that said sleeve can be rendered movable with respect to the hub by unmeshing said crown profiles and translating and turning the sleeve against the action of the spring, whereas the meshing of the crown profiles renders the sleeve and the hub integral with one another; and wherein the sleeve is provided with holes and the grip is anchored in said holes.

2. Racket according to claim 1, in which said element having a crown profile solid with the hub is a base fixed to the free extremity of the hub and bearing a collar, shaped with said profile.

3. Racket according to claim 1, in which said sleeve is of anodized extra strong aluminium.

4. Racket according to claim 1, in which said grip is shaped to conform to the hand of a particular individual.

* * * * *